US008428279B2

(12) United States Patent
Akino

(10) Patent No.: US 8,428,279 B2
(45) Date of Patent: Apr. 23, 2013

(54) CONDENSER MICROPHONE AND OUTPUT CONNECTOR THEREFOR

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 120 days.

(21) Appl. No.: 13/064,122

(22) Filed: Mar. 8, 2011

(65) Prior Publication Data

US 2011/0235830 A1 Sep. 29, 2011

(30) Foreign Application Priority Data

Mar. 24, 2010 (JP) ..... 2010-067711

(51) Int. Cl.
*H04R 25/00* (2006.01)

(52) U.S. Cl.
USPC ..... 381/174; 381/355

(58) Field of Classification Search ..... 381/174, 381/92–104
See application file for complete search history.

(56) References Cited

U.S. PATENT DOCUMENTS 8,213,660 B2 * 7/2012 Phillips ..... 381/355

FOREIGN PATENT DOCUMENTS

JP 2005311752 * 11/2005

* cited by examiner

*Primary Examiner* — Fan Tsang
*Assistant Examiner* — Padma Haliyur
(74) *Attorney, Agent, or Firm* — Manabu Kanesaka

(57) ABSTRACT

The output connector for a condenser microphone has a circuit board mounted with a capacitor element and a shield cover having a first through hole, a second through hole, and a third through hole and covering the whole surface of the circuit board arranged in a state in which a first pin, a second pin, and a third pin are inserted through the first through hole, the second through hole, and the third through hole respectively, and the shield cover has a non-conducting magnetic sheet having a first insertion hole, a second insertion hole, and a third insertion hole through which the first pin, the second pin, and the third pin are also inserted respectively, on at least one of an outer surface and an inner surface of the shield cover.

7 Claims, 4 Drawing Sheets

CONDENSER MICROPHONE AND OUTPUT CONNECTOR THEREFOR

CROSS-REFERENCE TO RELATED APPLICATION

The present application is based on, and claims priority from, Japanese Application Serial Number JP2010-067711, filed Mar. 24, 2010, the disclosure of which is hereby incorporated by reference herein in its entirety.

TECHNICAL FIELD

The present invention relates to an output connector for a condenser microphone. More particularly, it relates to an output connector for a microphone which has a function of shielding high-frequency electromagnetic waves radiated from a cellular phone or the like, and a condenser microphone provided with the said output connector.

BACKGROUND ART

A condenser microphone is configured so that an electrostatic acousto-electric converter in which a diaphragm and a backplate are arranged opposedly is included in a microphone unit, and an impedance converter such as a field effect transistor (FET) is incorporated because of its very high impedance. Usually, in the condenser microphone, a phantom power source is used, and microphone sound signals are delivered via a balanced shielded cable for a phantom power source.

To connect the balanced shielded cable, a 3-pin type output connector specified in EIAJ RC-5236 "Latch Lock Type Round Connector for Audio Equipment" is provided on the microphone casing (microphone grip for handheld microphone) side. By this output connector, the balanced shielded cable can be attached to and detached from the condenser microphone.

If strong electromagnetic waves radiated from a cellular phone or the like are applied to a microphone or a microphone cable in the state in which the balanced shielded cable is connected to the output connector, the electromagnetic waves intrude into the microphone casing through the output connector, and sometimes are detected and delivered from the microphone as audible frequency noise.

As one method for preventing this phenomenon, the present applicant has proposed an output connector of microphone having a shielding function in Patent Document 1 (Japanese Patent Application Publication No. 2005-311752). The configuration of this output connector is explained with reference to FIGS. 3A to 3C. FIG. 3A is a front view of the output connector, in which only a shield cover is shown as a cross section, FIG. 3B is a sectional view taken along the line B-B of FIG. 3A, and FIG. 3C is a plan view of the output connector shown in FIG. 3A.

An output connector 10 includes a disc-shaped connector base 11 consisting of an electrical insulator such as PBT (polybutylene terephthalate) resin. In the connector base 11, three pins of a first pin E for earthing, a second pin SH on the hot side of signal, and a third pin SC on the cold side of signal are penetratingly provided, for example, by press fit.

In this specification, the first pin E for earthing is sometimes referred simply to as the "earthing pin E", and the second pin SH on the hot side of signal and the third pin SC on the cold side of signal are sometimes referred simply to as the "signal pin SH" and "signal pin SC", respectively.

As for the handheld condenser microphone, as shown in FIG. 3B, the output connector 10 is mounted in an end portion of a microphone casing (microphone grip for the handheld microphone), not shown, via a connector housing 20. The connector housing 20 consists of a cylindrical body made of a metal such as a brass alloy, and also functions as the shield casing of the output connector.

In the connector base 11, an internally threaded hole 13 is formed toward the radial direction from the outer peripheral surface thereof. In the internally threaded hole 13, a male screw 12 for fixing the output connector 10 to the connector housing 20 is threadedly mounted.

According this configuration, as shown in FIG. 3B, by using a screwdriver or the like, not shown, through a round hole 21 formed in the connector housing 20, the male screw 12 is turned, pulled out to the outside in the radial direction, and caused to butt against the peripheral edge of the round hole 21. Thereby, the output connector 10 can be fixed firmly to the connector housing 20.

For example, as shown in Japanese Patent Application Publication No. 2005-311752 to prevent electromagnetic waves radiated from a cellular phone or the like from intruding into the microphone casing, a circuit board 14 and a shield cover 15 are provided on the base inner surface (the surface arranged on the inside of microphone, the upper surface in FIGS. 3A and 3B) side of the connector base 11.

Although not shown in the figures in detail, the circuit board 14 is a double-sided printed wiring board having three through holes through which the earthing pin E and the signal pins SH and SC are penetrated. On the back surface side opposed to the base inner surface of the connector base 11, a shield layer consisting of a copper foil solid pattern is formed. On the upper surface on the opposite side thereof, a capacitor element for blocking intrusion of high-frequency signals and a Zener diode element for preventing circuit destruction due to static electricity are mounted. For convenience in drawing the figures, only the capacitor element is shown in FIG. 3B by reference symbol 14*a*.

The capacitor element 14*a* and the Zener diode element are connected in parallel to between the earthing pin E and the signal pin SH, and further connected to between the earthing pin E and the signal pin SC. The capacitor element 14*a* functions as a bypass capacitor that allows a high-frequency current, which is caused by extraneous electromagnetic waves going to intrude into the microphone casing through the signal pins SH and SC, to flow to the earthing pin E side.

The shield cover 15 includes a ceiling part 15*a* that covers the upper surface of the circuit board 14 and a skirt part 15*b* that is fitted on the outer peripheral surface of the connector base 11. In the ceiling part 15*a*, as shown in FIG. 3C, three through holes of a through hole 151 for the earthing pin E, a through hole 152 for the signal pin SH, and a through hole 153 for the signal pin SC are formed.

To electrically connect the earthing pin E and the shield cover 15 to each other, the through hole 151 for the earthing pin E is formed as a hole having a diameter approximately equal to the diameter of the earthing pin E so as to be capable of being in contact with the earthing pin E, and finally, the earthing pin E is soldered to the shield cover 15. The shield layer consisting of a copper foil solid pattern formed on the back surface side of the circuit board 14 is also connected electrically to the earthing pin E via a predetermined wiring path.

In contrast, the through hole 152 for the signal pin SH and the through hole 153 for the signal pin SC are formed so as to have diameters larger than the diameters of the signal pins SH and SC, respectively, so as to be in non-contact with these pins. In order to keep the leak of a high-frequency magnetic field, which is generated from the wiring part and the like of the capacitor element 14*a*, into the microphone casing to a minimum when a high-frequency current flows in the capacitor element 14*a*, the through holes 152 and 153 are preferably formed so as to have as small diameters as possible.

According to this configuration, by the shield layer consisting of a copper foil solid pattern, which is formed on the circuit board 14, and the shield cover 15, a double shield is formed. Also, by the capacitor element 14*a* mounted on the circuit board 14, the high-frequency current caused by electromagnetic waves can be prevented from intruding through the signal pins SH and SC.

However, between the signal pin SH, SC and the through hole 152, 153, a gap for keeping the signal pin SH, SC in non-contact is present though being small. Also, by the flow of high-frequency current in the capacitor element 14*a* mounted on the circuit board 14, a high-frequency magnetic field is generated.

This high-frequency magnetic field can be prevented to some degree by an electrostatic shield using the shield cover 15. However, by a leaking high-frequency magnetic field, a high-frequency current is caused to flow by induction in the pattern of printed wiring board for outputting sound signals and the circuit parts mounted thereon in the microphone casing, and thereby noise is sometimes generated.

In the field of condenser microphone, it has been further demanded to reliably prevent the generation of noise caused by extraneous electromagnetic waves. Accordingly, an object of the present invention is to provide an output connector for a condenser microphone which has a function of shielding electromagnetic waves more reliably.

SUMMARY OF THE INVENTION

To achieve the above object, the present invention provides an output connector for a condenser microphone which is mounted in an end portion in a microphone casing of the condenser microphone, and is of a 3-pin type in which a first pin for earthing and second and third pins for signal are penetratingly provided on a connector base consisting of an electrical insulator, and in which on the base inner surface side located on the inside of the microphone casing of the connector base, a circuit board mounted with a capacitor element for high-frequency current bypass connected between the first pin and the second and third pins and a shield cover covering the whole surface of the circuit board are arranged in the state in which the pins are inserted therethrough, wherein on the outer surface and/or the inner surface of the shield cover, a magnetic sheet having pin insertion holes having diameters approximately equal to the diameters of the pins is provided additionally.

As a further preferable mode of the present invention, the magnetic sheet is made of a non-conducting and flexible sheet material containing magnetic powder in a resin, and the pin insertion holes are stuck fast to the peripheries of the pins.

The present invention also embraces a condenser microphone provided with the above-described output connector.

According to the present invention, on the base inner surface side located on the inside of the microphone casing of the connector base, the circuit board mounted with the capacitor element for high-frequency current bypass connected between the first pin and the second and third pins is arranged, and on the outer surface and/or the inner surface of the shield cover provided so as to cover the whole surface of the circuit board, the magnetic sheet preferably made of a non-conducting and flexible sheet material containing magnetic powder in a resin is further provided additionally so as to be stuck fast to the peripheries of the pins. Thereby, the leak of a high-frequency magnetic field, which is generated by the flow of a high-frequency current in the capacitor element for high-frequency current bypass, into the microphone casing can be prevented reliably. Therefore, an output connector for a condenser microphone which has a function of shielding electromagnetic waves more reliably, and a condenser microphone having this output connector are provided.

DETAILED DESCRIPTION

An embodiment of the present invention will now be described with reference to FIGS. 1A, 1B, 2A and 2B. The present invention is not limited to the embodiment described below. This embodiment is explained by applying the same reference symbols to elements that need not be changed from the elements of the conventional example explained before with reference to FIGS. 3A to 3C.

Figure 1A:
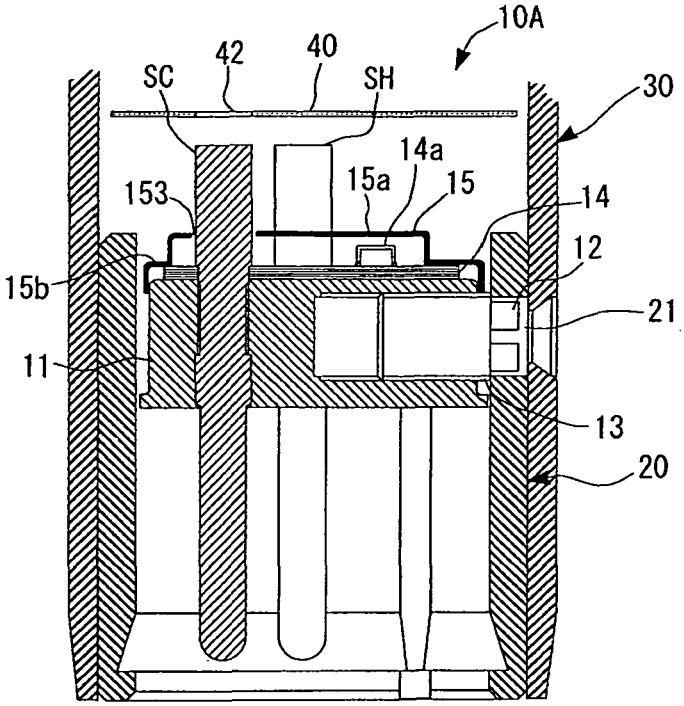
FIG. 1A is a sectional view showing a state before a magnetic sheet is mounted to an output connector in an embodiment in accordance with the present invention.
Figure 1B:
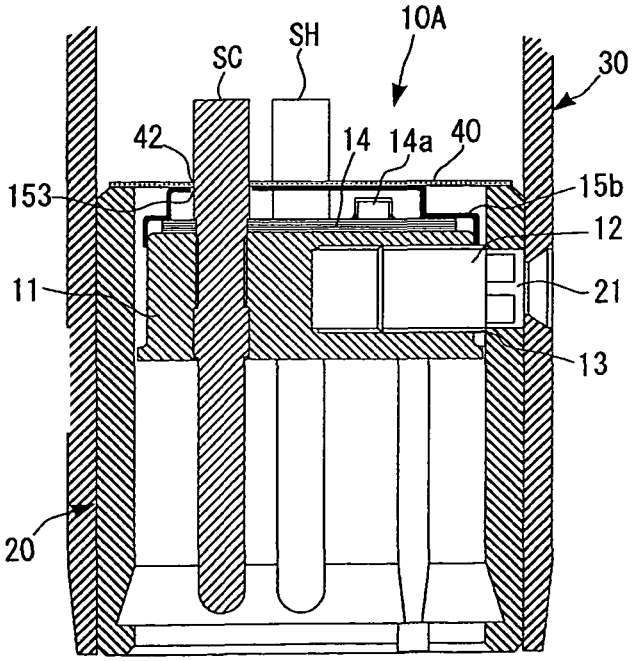
FIG. 1B is a sectional view showing a state in which a magnetic sheet has been mounted to an output connector in an embodiment in accordance with the present invention.

Referring to FIGS. 1A and 1B, an output connector 10A in accordance with this embodiment also includes a disc-shaped connector base 11 consisting of an electrical insulator such as PBT (polybutylene terephthalate) resin.

In the connector base 11, three pins of a first pin E for earthing (an earthing pin E), a second pin SH on the hot side of signal (a signal pin SH), and a third pin SC on the cold side of signal (a signal pin SC) are penetratingly provided, for example, by press fit.

In the connector base 11, an internally threaded hole 13 is formed toward the radial direction from the outer peripheral surface thereof. In the internally threaded hole 13, a male screw 12 for fixing the output connector 10A to a connector housing 20 is threadedly mounted.

Although the connector housing 20 is mounted in an end portion of a microphone casing 30 in FIGS. 1A and 1B, the connector housing 20 may be integral with the microphone casing 30. Also, although not shown in the figures, in the other end portion of the microphone casing 30, a condenser microphone unit is provided. In the microphone casing 30, a printed wiring board having a sound signal output circuit and the like is housed.

To prevent electromagnetic waves radiated from a cellular phone or the like from intruding into the microphone casing 30, a circuit board 14 and a shield cover 15 are provided on the base inner surface (the surface arranged on the inside of microphone, the upper surface in FIGS. 1A and 1B) side of the connector base 11.

Although not shown in the figures in detail, the circuit board 14 is a double-sided printed wiring board having three through holes corresponding to the earthing pin E and the signal pins SH and SC. On the back surface side opposed to the base inner surface of the connector base 11, a shield layer consisting of a copper foil solid pattern is formed. On the upper surface on the opposite side thereof, a capacitor element 14*a* for blocking intrusion of high-frequency signals and a Zener diode element for preventing circuit destruction due to static electricity are mounted. The illustration of the Zener diode element is omitted.

As explained before, the capacitor element 14*a* and the Zener diode element are connected in parallel to between the earthing pin E and the signal pin SH, and further connected to between the earthing pin E and the signal pin SC. The capacitor element 14*a* functions as a bypass capacitor that allows a high-frequency current, which is caused by extraneous electromagnetic waves going to intrude into the microphone casing through the signal pins SH and SC, to flow to the earthing pin E side.

Figure 3A:
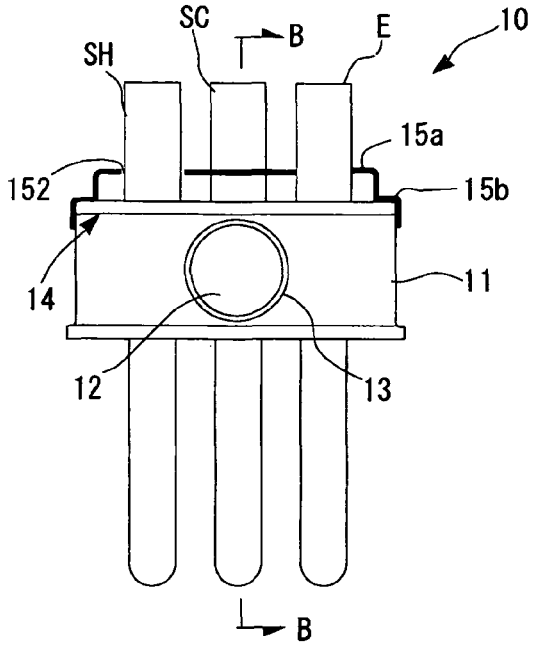
FIG. 3A RELATED ART
FIG. 3A is a front view of a conventional output connector.
Figure 3B:
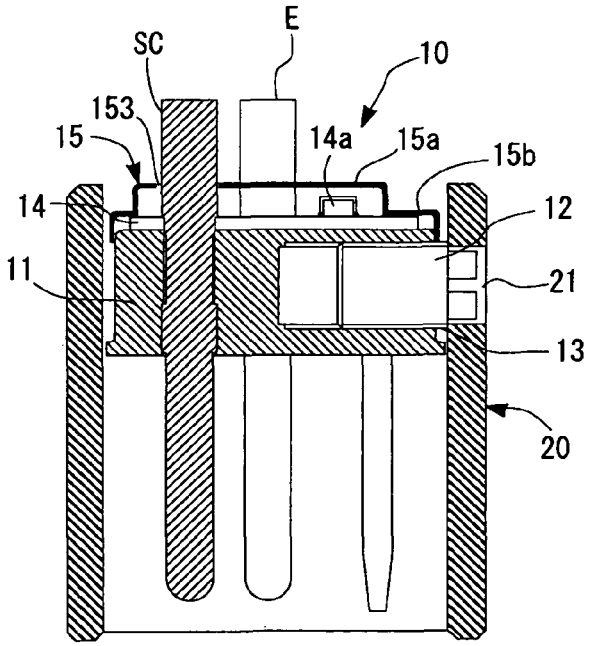
FIG. 3B RELATED ART
FIG. 3B is a sectional view taken along the line B-B of FIG. 3A.
Figure 3C:
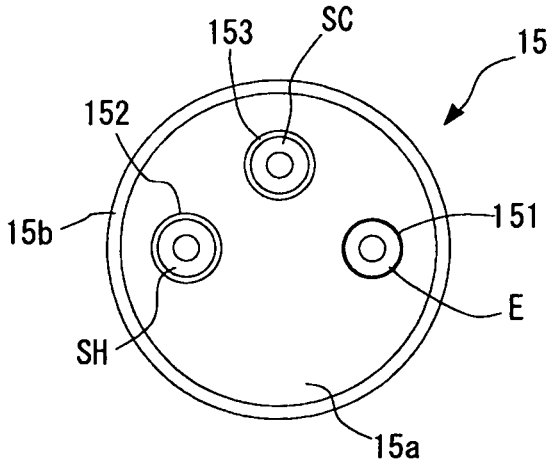
FIG. 3C RELATED ART
FIG. 3C is a plan view of the conventional output connector shown in FIG. 3A.

The shield cover 15 includes a ceiling part 15*a* that covers the upper surface of the circuit board 14 and a skirt part 15*b* that is fitted on the outer peripheral surface of the connector base 11. In the ceiling part 15*a*, as shown in FIG. 3C, three through holes of a through hole 151 for the earthing pin E, a through hole 152 for the signal pin SH, and a through hole 153 for the signal pin SC are formed.

To electrically connect the earthing pin E and the shield cover 15 to each other, the through hole 151 for the earthing pin E is formed as a hole having a diameter approximately equal to the diameter of the earthing pin E so as to be capable of being in contact with the earthing pin E, and finally, the earthing pin E is soldered to the shield cover 15. Also, the shield cover 15 is connected electrically to the shield layer, which is formed on the back surface side of the circuit board 14, by a predetermined conducting means.

The through hole 152 for the signal pin SH and the through hole 153 for the signal pin SC are formed so as to have diameters larger than the diameters of the signal pins SH and SC, respectively, so as to be in non-contact with these pins.

In order to keep the leak of a high-frequency magnetic field, which is generated from the wiring part and the like of the capacitor element 14*a*, into the microphone casing 30 to a minimum when a high-frequency current flows in the capacitor element 14*a*, the through holes 152 and 153 are formed so as to have as small diameters as possible. Nevertheless, the high-frequency magnetic field sometimes leaks.

In this case, by the leaking high-frequency magnetic field, a high-frequency current is caused to flow by induction in the pattern of printed wiring board for outputting sound signals and the circuit parts mounted thereon in the microphone casing 30, and thereby noise is sometimes generated.

In the present invention, to prevent the generation of noise caused by the leaking high-frequency magnetic field, as shown in FIGS. 1A and 1B, a magnetic sheet 40 is further provided in addition to the shield cover 15.

As the magnetic sheet 40, a non-conducting and flexible sheet material that is a thin film containing magnetic powder in a resin is preferably employed. As a commercially-available magnetic sheet 40, for example, a noise suppression sheet, thin and environment-compatible type (thickness: 0.05 mm, 0.1 mm), manufactured by TDK Corporation is available.

Figure 2A:
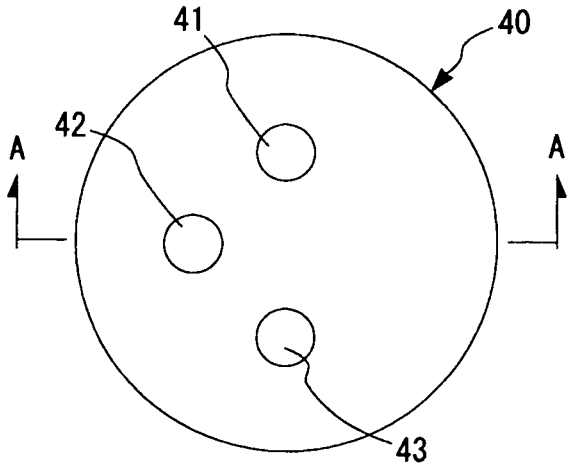
FIG. 2A is a plan view of a magnetic sheet applied to the present invention.
Figure 2B:
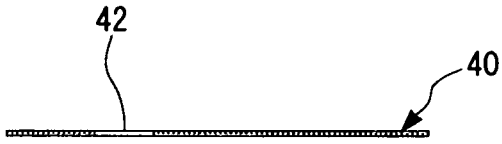
FIG. 2B is a sectional view taken along the line A-A of FIG. 2A.

As shown in FIGS. 2A and 2B, pin insertion holes 41, 42, and 43 having diameters substantially equal to the outside diameters of the earthing pin E and the signal pins SH and SC area bored into the magnetic sheet 40. The magnetic sheet 40 is mounted in the state in which these pin insertion holes 41, 42, and 43 are stuck fast to the earthing pin E and the signal pins SH and SC so that gaps are not produced around these pins.

In the case where the periphery of the through hole 151 for the earthing pin E formed in the shield cover 15 is reliably closed by the earthing pin E, the pin insertion hole 41 for the earthing pin E may have a diameter larger than the outside diameter of the earthing pin E.

From the viewpoint of workability, as shown in FIGS. 1A and 1B, it is preferable that the magnetic sheet 40 be additionally provided on the outer surface of the shield cover 15 via a double-face adhesive tape or an adhesive. The magnetic sheet 40 may be provided on only a ceiling part 15*a* of the shield cover 15. Preferably, however, as shown in FIG. 1B, the outside diameter of the magnetic sheet 40 may be approximately equal to the outside diameter of the connector housing 20 or the inside diameter of the microphone casing 30.

As another mode, the magnetic sheet 40 may be additionally provided on the inner surface of the shield cover 15, or may be provided on both the outer and inner surfaces of the shield cover 15. In any case, the magnetic sheet 40 can be applied easily without a design change of the existing output connector 10 as shown in FIGS. 3A to 3C because it is thin and highly flexible.

According to the present invention, at least the gap between the signal pin SH and the through hole 152 and the gap between the signal pin SC and the through hole 153, preferably including the gap between the earthing pin E and the through hole 151, are closed by the magnetic sheet 40.

Therefore, when a high-frequency current flows in the capacitor element 14*a*, a high-frequency magnetic field generated from the wiring part and the like of the capacitor element 14*a* is blocked. Thereby, the generation of noise caused by the leaking high-frequency magnetic field can be prevented reliably.

The invention claimed is:

1. An output connector for a condenser microphone which is mounted in an end portion in a microphone casing of the condenser microphone, the output connector comprising:

a microphone casing;

a connector base comprising an electrical insulator, present in the microphone casing;

a first pin for earthing, and a second pin and a third pin for signals penetratingly provided on the connector base;

a circuit board mounted with a capacitor element for high-frequency current bypass connected between the first pin and the second pin and the third pin in an inner surface side of the connector base located on an inside of the microphone casing; and a shield cover having a first through hole, a second through hole, and a third through hole and covering a whole surface of the circuit board arranged in a state in which the first pin, the second pin, and the third pin are inserted through the first through hole, the second through hole, and the third through hole respectively, wherein the shield cover has a magnetic sheet having a first insertion hole, a second insertion hole, and a third insertion hole through which the first pin, the second pin, and the third pin are inserted respectively, on at least one of an outer surface and an inner surface of the shield cover, a diameter of the first through hole and a diameter of the first pin are substantially equal, diameters of the second through hole and the third through hole are larger than diameters of the second pin and the third pin respectively, and at least the second insertion hole and the third insertion hole are in close contact with outer peripheries of the second pin and the third pin respectively.

2. The output connector for a condenser microphone according to claim 1, wherein the magnetic sheet is made of a non-conducting and flexible sheet material containing magnetic powder in a resin.

3. A condenser microphone, comprising:

the output connector for the condenser microphone described in claim 1.

4. The output connector for a condenser microphone according to claim 1, wherein the magnetic sheet covers spaces formed between the second through hole and the second pin, and between the third through hole and the third pin.

5. The output connector for a condenser microphone according to claim 1, wherein the shield cover has a ceiling part on an upper surface thereof and a skirt part that fits on an outer peripheral surface of the connector base, and the first through hole, the second through hole, and the third through hole are formed on the ceiling part.

6. The output connector for a condenser microphone according to claim 5, wherein the magnetic sheet is present on the ceiling part.

7. The output connector for a condenser microphone according to claim 2, wherein the magnetic sheet is a thin film.

* * * * *